US007299665B2

(12) United States Patent
Kim et al.

(10) Patent No.: US 7,299,665 B2
(45) Date of Patent: Nov. 27, 2007

(54) LIFT FOR DRUM-TYPE WASHING MACHINE

(75) Inventors: Jin Woong Kim, Gwangmyeong-si (KR); Soo Young Oh, Seoul (KR); Hyun Seok Seo, Incheon-si (KR); Tae Hee Lee, Seoul (KR); Joon Woo Kim, Gwangmyeong-si (KR); Kyung Chul Woo, Seoul (KR)

(73) Assignee: LG Electronics Inc., Seoul (KR)

( * ) Notice: Subject to any disclaimer, the term of this patent is extended or adjusted under 35 U.S.C. 154(b) by 590 days.

(21) Appl. No.: 10/804,236

(22) Filed: Mar. 19, 2004

(65) Prior Publication Data

US 2005/0204783 A1 Sep. 22, 2005

(51) Int. Cl.
*D06F 37/06* (2006.01)

(52) U.S. Cl. ..... 68/24; 68/58; 68/142

(58) Field of Classification Search ..... 68/24, 68/58, 142

See application file for complete search history.

(56) References Cited

U.S. PATENT DOCUMENTS

| | | | | |
|---|---|---|---|---|
| 2,296,257 | A | 9/1942 | Breckenridge | |
| 2,305,695 | A * | 12/1942 | Hayes | 68/60 |
| 2,480,929 | A * | 9/1949 | Hyman | 34/108 |
| 3,946,500 | A * | 3/1976 | Barrett et al. | 34/139 |
| 5,289,703 | A | 3/1994 | Hiyashi et al. | |
| 5,782,111 | A * | 7/1998 | Sights et al. | 68/142 |
| 6,463,767 | B2 | 10/2002 | Uzkureit et al. | |
| 6,889,399 | B2 * | 5/2005 | Steiner et al. | 8/159 |
| 7,096,695 | B2 * | 8/2006 | No et al. | 68/58 |
| 2002/0083743 | A1 | 7/2002 | Uszkureit et al. | |
| 2004/0123634 | A1 | 7/2004 | Kim et al. | |
| 2005/0217035 | A1 * | 10/2005 | Steiner et al. | 8/149.3 |

FOREIGN PATENT DOCUMENTS

| | | |
|---|---|---|
| DE | 537758 | * 11/1931 |
| EP | 1350880 | 10/2003 |
| FR | 1136981 | 5/1957 |
| FR | 1580849 | 9/1969 |
| JP | 09-215894 | 8/1997 |
| JP | 10235075 | 9/1998 |
| KR | 1999-85001 | 6/1999 |
| KR | 2004022991 A | * 3/2004 |

OTHER PUBLICATIONS

Electronic translation of JP 09-215894.*
Electronic translation of DE 537758.*

* cited by examiner

*Primary Examiner*—Joseph L. Perrin
(74) *Attorney, Agent, or Firm*—Ked & Associates, LLP

(57) ABSTRACT

A drum-type washing machine, having a plurality of lifts installed on an inner circumferential surface of a drum, enables improved washing performance by providing friction plates on the inclined sides of each lift to increase a frictional force between the lift and laundry. Each lift includes a pair of inclined sides, disposed in opposition to each other to form a shape having a regular trapezoidal cross-section, for lifting laundry; and a pair of friction plates, consisting of a pair of opposing surfaces respectively provided on each inclined side and having a multitude of protuberances formed on both faces, to increase a frictional force with respect to the laundry.

21 Claims, 6 Drawing Sheets

LIFT FOR DRUM-TYPE WASHING MACHINE

BACKGROUND OF THE INVENTION

1. Field of the Invention

The present invention relates to a drum-type washing machine, and more particularly, to a drum-type washing machine employing a lift provided with a friction plate for increasing a frictional force acting on laundry.

2. Discussion of the Related Art

Generally speaking, laundering using a drum-type washing machine is carried out using a frictional force between the laundry and a rotating drum that receives the driving force of a motor. Such a method causes little damage to the laundry, prevents the laundry from getting tangled, and achieves such washing effects as beating and rubbing.

FIG. 1 illustrates a drum-type washing machine according to a related art, having a plurality of lifts 1 axially installed on the inner circumferential surface of a drum. An example of such a lift is shown in FIG. 2.

Referring to FIG. 1, a cylindrical drum 2 for receiving and washing laundry is mounted within a tub 8 for holding washing water, such that the drum lies parallel with respect to a foundation. A rotational shaft 7 is connected to the drum 2 to rotate the drum forwardly and reversely, thereby the laundry to be washed inside the drum. This rotating action results from a rotating force transferred to the drum 2 using an electrical motion system made up of a motor 3 that drives a belt 5 linking a pair of pulleys 4 and 6, thus allowing full directional control of the rotation of the drum.

Each lift 1 has a regular trapezoidal cross-section and inclined sides 1*a* and 1*b* having smooth faces. Typically, the lifts 1 are made of a metal or plastic material.

In the operation of a drum-type washing machine constructed as above, laundry is placed in the drum 2, water is supplied to the tub 8, and the rotational shaft 7, driven by the motor 3, rotates the drum. As the drum 2 rotates, the laundry is lifted by at least one of the lifts 1, from a lower area of the drum's interior and up one side of the interior, until reaching a point where the inclined side 1*a* or 1*b* passes a plane level to the foundation, whereupon the lifted laundry falls back down to the drum's lower area. The laundry is thus washed by a combination of actions occurring in the washing water, including the drum's rotation and the laundry's lifting and falling. As the drum 2 rotates, the laundry is lifted and falls to produce a sudsing action in the washing water.

In the drum-type washing machine according to the related art, the smooth faces of the inclined sides 1*a* and 1*b* provide limited frictional force on the laundry. As a result, the lifting action is also limited, so that the laundry slides from the lift too soon, to fall only a short distance, which creates only a light sudsing action. Optimum washing, however, requires vigorous sudsing.

As above, the frictional force acting on the laundry in the drum-type washing machine of the related art is insufficient. Moreover, with larger and heavier laundry loads, the necessary frictional force is even greater. Therefore, the washing performance of the drum-type washing machine of the related art is less than optimum.

SUMMARY OF THE INVENTION

Accordingly, the present invention is directed to a drum-type washing machine having a lift that substantially obviates one or more problems due to limitations and disadvantages of the related art.

An object of the present invention is to provide a drum-type washing machine having a plurality of lifts, by which washing performance is improved by providing friction plates on the inclined sides of each lift to increase a frictional force between the lift and laundry.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the specification and claims hereof as well as the appended drawings.

To achieve these objects and other advantages and in accordance with the purpose of the invention, as embodied and broadly described herein, there is provided a drum-type washing machine having a lift installed on an inner circumferential surface of a drum. The lift comprises a pair of inclined sides, disposed in opposition to each other to form a shape having a regular trapezoidal cross-section, for lifting laundry; and a pair of friction plates, consisting of a pair of opposing faces respectively provided on each of the pair of inclined sides and having a multitude of protuberances formed on both faces, to increase a frictional force with respect to the laundry. Preferably, the friction plates are formed of a rubber-based material to increase a frictional force with respect to laundry loaded in the drum.

In the above drum-type washing machine, the formation of the protuberances of the pair of friction plates may be realized as a series of ridges each having a predetermined width and height, as an array of projections each having a predetermined length, width, and height, or as an array of nipples each having a predetermined base diameter and height.

It is to be understood that both the foregoing general description and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Throughout the drawings, like elements are indicated using the same or similar reference designations where possible.

In a drum-type washing machine according to the present invention, a plurality of lifts is installed on an inner circumferential surface of the drum. Each lift is comprised of a pair of inclined sides for lifting laundry and a pair of friction plates to increase a frictional force with respect to the laundry. To optimize the frictional force, the friction plates 10*a* and 10*b* are preferably formed of a rubber-based material. The inclined sides are disposed in opposition to each other to form a shape having a regular trapezoidal cross-section. The friction plates, consisting of two opposing faces respectively provided on each of the pair of inclined sides, have a multitude of protuberances formed on both faces. As in the case of the related art, each lift has a regular trapezoidal cross-section.

Figure 1:
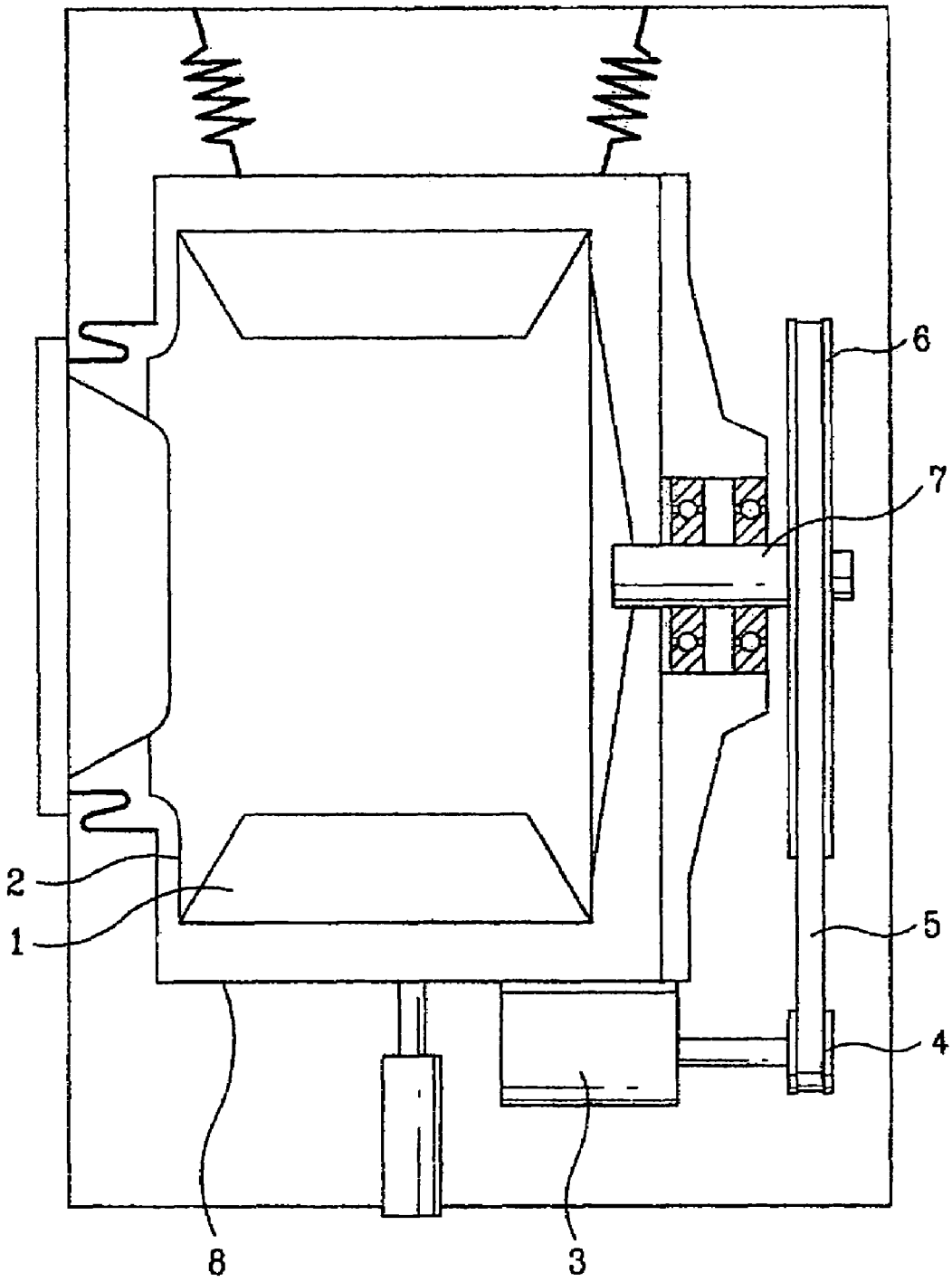
FIG. 1 Prior Art
FIG. 1 is a schematic cross-sectional side view of a drum-type washing machine according to a related art.
Figure 2:
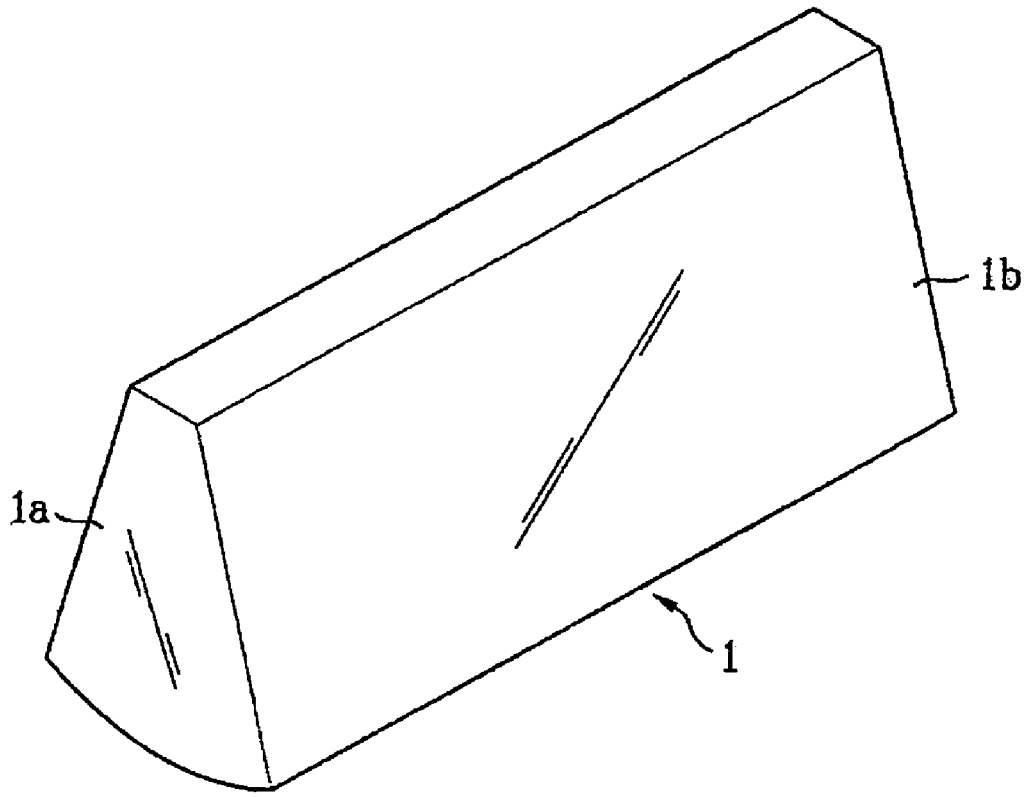
FIG. 2 Prior Art
FIG. 2 is a perspective view of a lift in FIG. 1.
Figure 3:
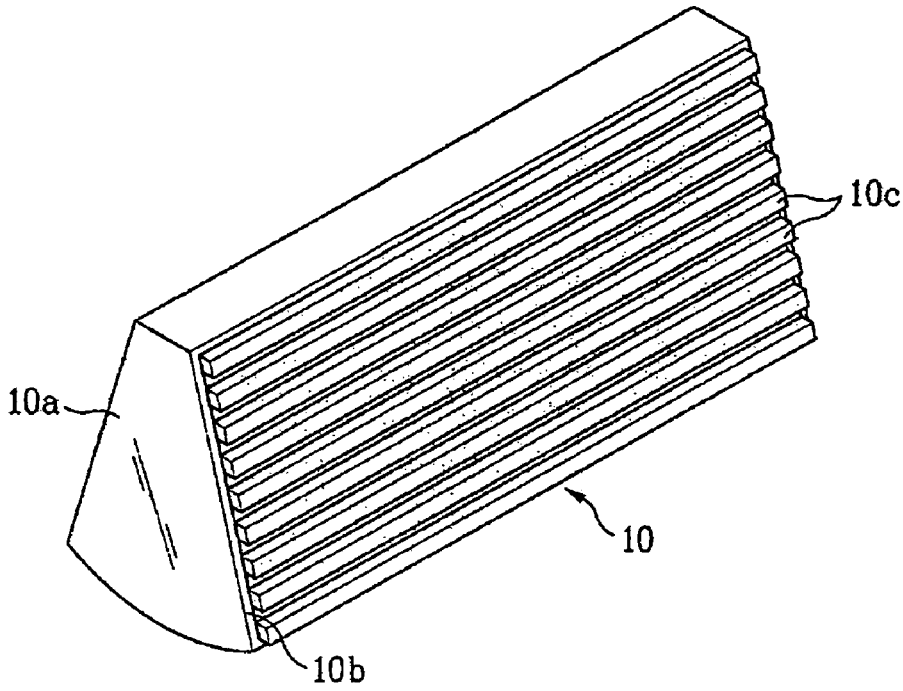
FIG. 3 is a perspective view of a lift according to a first embodiment of the present invention.

According to the first embodiment of the present invention, as shown in FIG. 3, the inclined sides of each of a plurality of lifts 10 are respectively provided with an opposing pair of friction plates 10*a* and 10*b* having a multitude of protuberances to increase a frictional force acting on laundry loaded in the drum. The protuberances are arranged as a series of ridges 10*c* extending axially with respect to the drum, i.e., lengthwise with respect to the lifts. All of the ridges 10*c* are equal in size, and the width of each ridge is substantially the same as its height. The ridges 10*c* extend, along straight lines, the full length of both faces of the lift to provide maximum frictional force.

The increased frictional force provided to the inclined sides of the lift 10 enables the lift to lift laundry to a higher rotational point, thus allowing the laundry to fall from a greater distance and thereby enhancing washing performance accordingly. Also, although washing power may be diminished somewhat for maximum loads applied to the drum, the increased frictional force increases an impacting force applied to the laundry during a swing movement, i.e., an abrupt reverse turning movement, of the drum to maintain the overall washing power.

Figure 4:
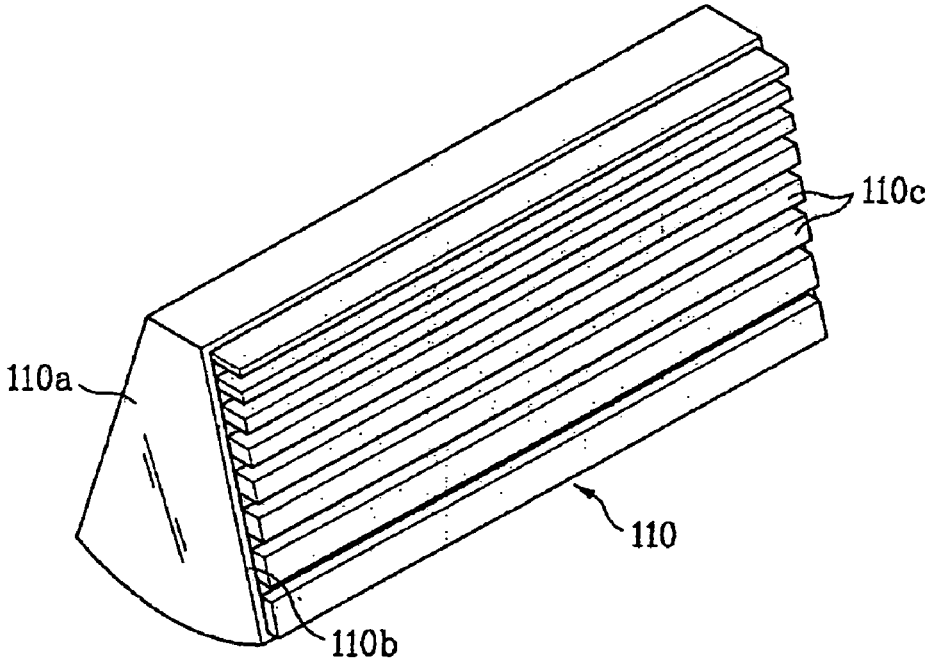
FIG. 4 is a perspective view of a lift according to a second embodiment of the present invention.

According to the second embodiment of the present invention, as shown in FIG. 4, the inclined sides of each of a plurality of lifts 110 are respectively provided with an opposing pair of friction plates 110*a* and 110*b* having a multitude of protuberances to increase the frictional force. The protuberances are arranged as a series of ridges 110*c*. To enhance the effectiveness of the frictional force, the width and height of the ridges lid vary depending on their position relative to the drum. That is, the width of each ridge 110*c* gradually decreases, from the inner circumferential surface of the drum to its center, such that the widest ridge is near the drum's circumferential surface and the narrowest ridge is near the drum's center. At the same time, the height of each ridge 110*c* gradually increases, such that the shortest ridge is near the drum's circumferential surface and the tallest ridge is near the drum's center.

Figure 5:
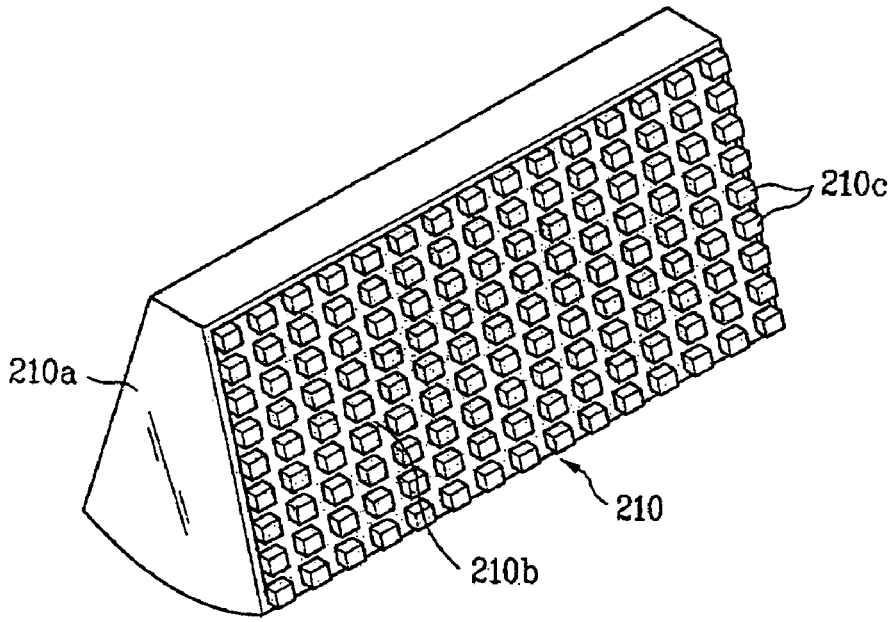
FIG. 5 is a perspective view of a lift according to a third-embodiment of the present invention.

According to the third embodiment of the present invention, as shown in FIG. 5, the inclined sides of each of a plurality of lifts 210 are respectively provided with an opposing pair of friction plates 210*a* and 210*b* having a multitude of protuberances to increase a frictional force acting on laundry loaded in the drum. The protuberances are arranged as an array of projections 210*c* extending in two dimensions to cover both faces of the lift. All of the projections are equal in size and substantially cubical.

Figure 6:
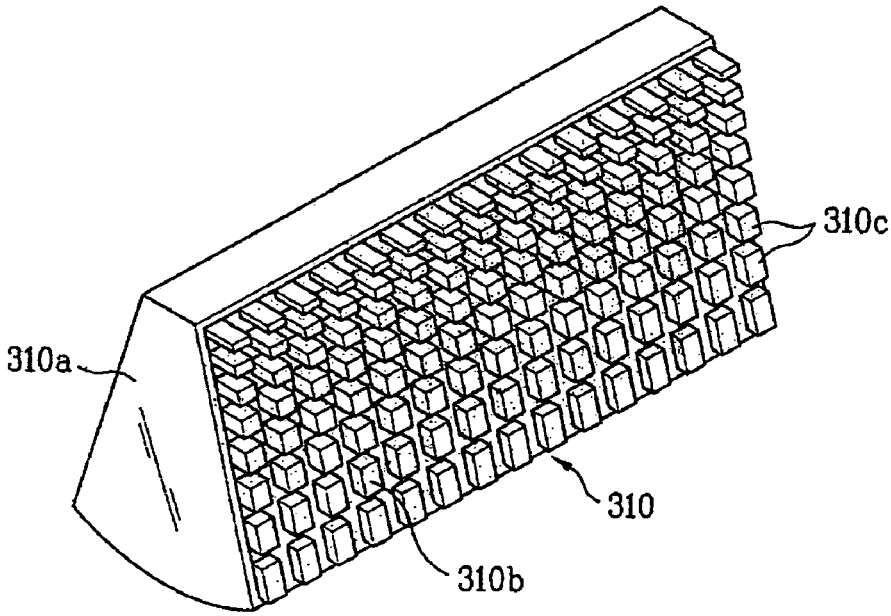
FIG. 6 is a perspective view of a lift according to a fourth embodiment of the present invention.

According to the fourth embodiment of the present invention, as shown in FIG. 6, the inclined sides of each of a plurality of lifts 310 are respectively provided with an opposing pair of friction plates 310*a* and 310*b* having a multitude of protuberances to increase the frictional force. The protuberances are arranged as an array of projections 310*c*. To enhance the effectiveness of the frictional force, the width and height of the projections 310*c* vary depending on their position relative to the drum, while their length remains constant. That is, the width of each projection 310*c* gradually decreases, from the inner circumferential surface of the drum to its center, such that the widest projection is near the drum's circumferential surface and the narrowest projection is near the drum's center. At the same time, the height of each projection 310*c* gradually increases, such that the shortest projection is near the drum's circumferential surface and the tallest projection is near the drum's center.

Figure 7:
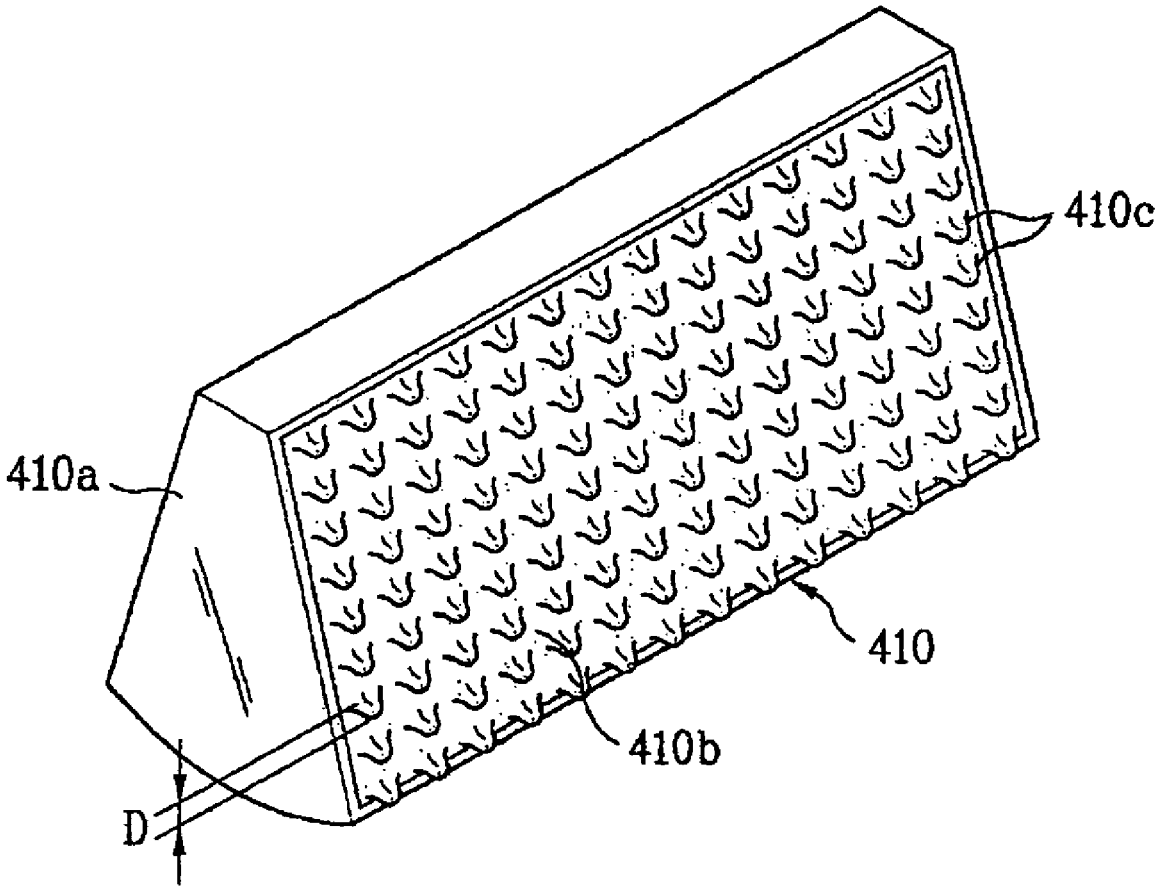
FIG. 7 is a perspective view of a lift according to a fifth embodiment of the present invention.

According to the fifth embodiment of the present invention, as shown in FIG. 7, the inclined sides of each of a plurality of lifts 410 are respectively provided with an opposing pair of friction plates 410*a* and 410*b* having a multitude of protuberances to increase a frictional force acting on laundry loaded in the drum. The protuberances are arranged as an array of nipples 410*c* extending in two dimensions to cover both faces of the lift, the base diameter D and height of all nipples being substantially equal.

Figure 8:
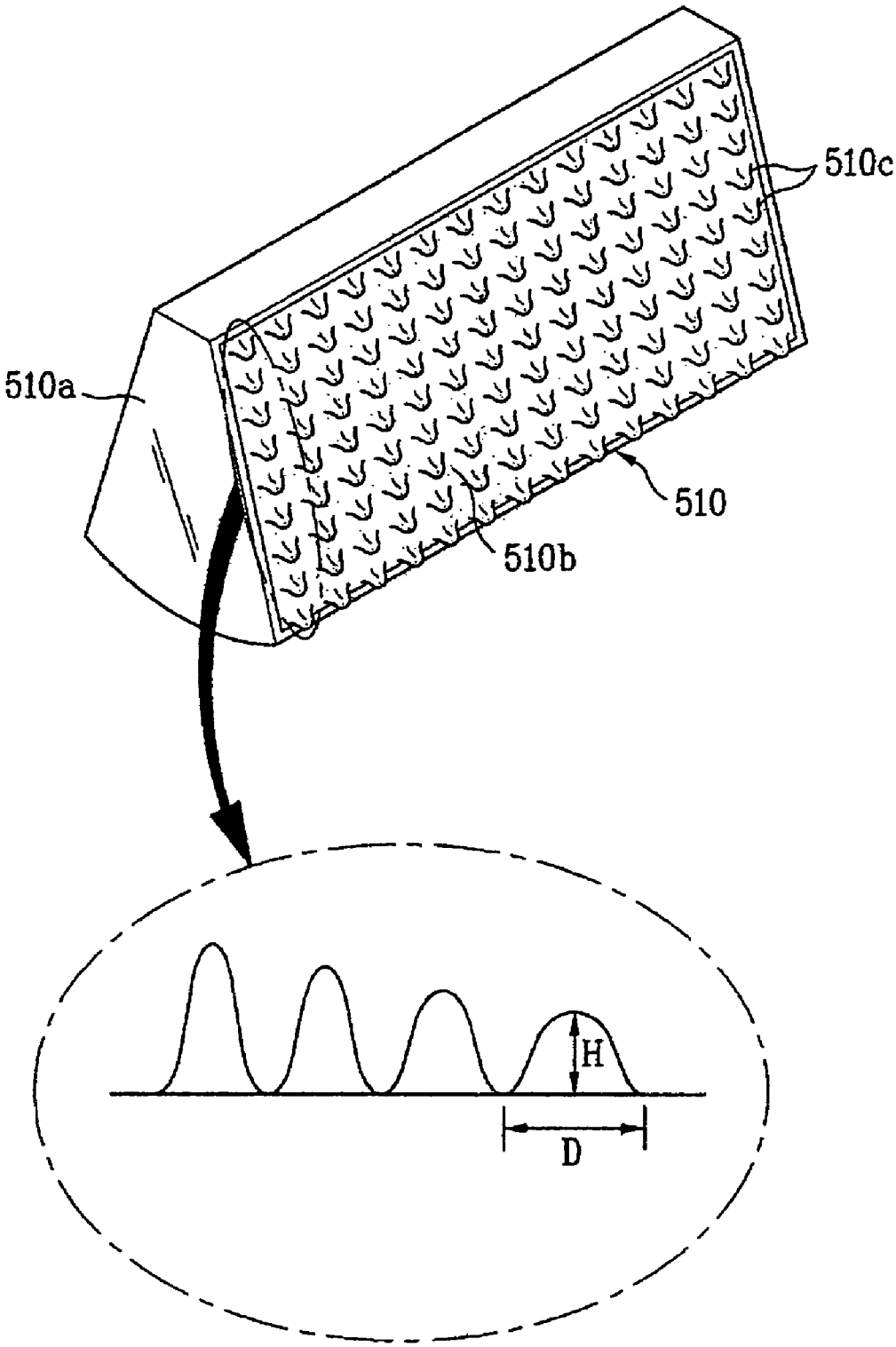
FIG. 8 is a perspective view of a lift according to a sixth embodiment of the present invention.

According to the sixth embodiment of the present invention, as shown in FIG. 8, the inclined sides of each of a plurality of lifts 510 are respectively provided with an opposing pair of friction plates 510*a* and 510*b* having a multitude of protuberances to increase the frictional force. The protuberances are arranged as an array of nipples 510*c*. To enhance the effectiveness of the frictional force, the base diameter D and height H of the nipples 510*c* vary depending on their position relative to the drum. That is, the base diameter D of each nipple 510*c* gradually decreases, from the inner circumferential surface of the drum to its center, such that the widest nipple is near the drum's circumferential surface and the narrowest nipple is near the drum's center. At the same time, the height H of each nipple 510*c* gradually increases, such that the shortest nipple is near the drum's circumferential surface and the tallest nipple is near the drum's center.

In the event of a metal-based lift, the above-described protuberances of the present invention may be integrally formed with the inclined sides the lift using an embossing process, such as a stamping technique, after fabricating the lift's basic shape. In the event of a plastic-based lift, the above-described protuberances may be integrally formed with the inclined sides of the lift at the time of forming the lift by injection molding.

By adopting the drum-type washing machine having a plurality of lifts according to the present invention, the frictional force acting on the laundry during washing is increased by the rubber-based friction plates provided on the inclined sides of each lift, so that the laundry is lifted higher and falls from a greater distance, to thereby enhance a sudsing action and improve washing performance. Moreover, the present invention optimizes an impacting force acting on the laundry through a swing movement of the drum, thereby maintaining the washing performance when a maximum load is applied to the drum.

It will be apparent to those skilled in the art that various modifications and variations can be made in the present invention. Thus, it is intended that the present invention covers such modifications and variations, provided they come within the scope of the appended claims and their equivalents.

What is claimed is:

1. A drum-type washing machine having a lift installed on an inner circumferential surface of a drum, the lift comprising:

a pair of inclined sides, disposed in opposition to each other to form a shape having a regular trapezoidal cross-section, configured to lift laundry; and a pair of friction plates, including a pair of opposing surfaces, respectively, provided on each of said pair of inclined sides and having a plurality of protuberances formed on both faces, to increase a frictional force with respect to the laundry, wherein the protuberances of said pair of friction plates are an array of projections each having a predetermined length, width, and height, and wherein the predetermined width and height of the projections vary with respect to proximity to the center of the drum, such that the width gradually decreases toward the center of the drum and the height gradually increases toward the center of the drum.

2. The drum-type washing machine as claimed in claim 1, wherein the projections are substantially cubical.

3. The drum-type washing machine as claimed in claim 1, wherein said pair of friction plates is formed of a rubber-based material to increase a frictional force with respect to laundry loaded in the drum.

4. The drum-type washing machine as claimed in claim 1, wherein the lift is made of a metal-based material.

5. The drum-type washing machine as claimed in claim 4, wherein said pair of friction plates is formed by an embossing process.

6. The drum-type washing machine as claimed in claim 1, wherein the lift is made of a plastic-based material.

7. The drum-type washing machine as claimed in claim 6, wherein said pair of friction plates is formed by an injection molding process.

8. A drum-type washing machine having a lift installed on an inner circumferential surface of a drum, the lift comprising:

a pair of inclined sides, disposed in opposition to each other to form a shape having a regular trapezoidal cross-section, configured to lift laundry; and a pair of friction plates, including a pair of opposing surfaces, respectively, provided on each of said pair of inclined sides and having a plurality of protuberances formed on both faces, to increase a frictional force with respect to the laundry, wherein the protuberances of said pair of friction plates are a series of ridges each having a predetermined width and height, and wherein the predetermined width and height of the ridges vary with respect to a proximity to a center of the drum, such that the width gradually decreases toward the center of the drum and the height gradually increases toward the center of the drum.

9. The drum-type washing machine as claimed in claim 8, wherein said pair of friction plates is formed of a rubber-based material to increase a frictional force with respect to laundry loaded in the drum.

10. The drum-type washing machine as claimed in claim 8, wherein the predetermined width of the ridges is substantially equal to the predetermined height.

11. The drum-type washing machine as claimed in claim 8, wherein the lift is made of a metal-based material.

12. The drum-type washing machine as claimed in claim 11, wherein said pair of friction plates is formed by an embossing process.

13. The drum-type washing machine as claimed in claim 8, wherein the lift is made of a plastic-based material.

14. The drum-type washing machine as claimed in claim 13, wherein said pair of friction plates is formed by an injection molding process.

15. A drum-type washing machine having a lift installed on an inner circumferential surface of a drum, the lift comprising:

a pair of inclined sides, disposed in opposition to each other to form a shape having a regular trapezoidal cross-section, configured to lift laundry; and a pair of friction plates including a pair of opposing surfaces, respectively, provided on each of said pair of inclined sides and having a plurality of protuberances formed on both faces, to increase a frictional force with respect to the laundry, wherein the protuberances of said pair of friction plates are an array of nipples each having a predetermined base diameter and height, and wherein the predetermined base diameter and height of the nipples vary with respect to proximity to the center of the drum, such that the base diameter gradually decreases toward the center of the drum and the height gradually increases toward the center of the drum.

16. The drum-type washing machine as claimed in claim 15, wherein the predetermined base diameter of the nipples is substantially equal to the predetermined height.

17. The drum-type washing machine as claimed in claim 15, wherein said pair of friction plates is formed of a rubber-based material to increase a frictional force with respect to laundry loaded in the drum.

18. The drum-type washing machine as claimed in claim 15, wherein the lift is made of a metal-based material.

19. The drum-type washing machine as claimed in claim 18, wherein said pair of friction plates is formed by an embossing process.

20. The drum-type washing machine as claimed in claim 15, wherein the lift is made of a plastic-based material.

21. The drum-type washing machine as claimed in claim 20, wherein said pair of friction plates is formed by an injection molding process.

* * * * *